US009488353B2

(12) United States Patent
Wang

(10) Patent No.: US 9,488,353 B2
(45) Date of Patent: Nov. 8, 2016

(54) POSITIONING STRUCTURE OF ELECTRICAL ELEMENT OF LED LAMP

(71) Applicant: HABEMIT INTERNATIONAL CO. LTD., Zhongli (TW)

(72) Inventor: Chin-Wen Wang, Zhongli (TW)

(73) Assignee: HABEMIT INTERNATIONAL CO. LTD., Taoyuan County (TW)

( * ) Notice: Subject to any disclaimer, the term of this patent is extended or adjusted under 35 U.S.C. 154(b) by 154 days.

(21) Appl. No.: 14/515,546

(22) Filed: Oct. 16, 2014

(65) Prior Publication Data

US 2016/0053976 A1 Feb. 25, 2016

(30) Foreign Application Priority Data

Aug. 21, 2014 (TW) ..... 103214967 U

(51) Int. Cl.

| | |
|---|---|
| ***F21V 23/00*** | (2015.01) |
| ***F21V 23/02*** | (2006.01) |
| *F21W 131/103* | (2006.01) |
| *F21Y 101/00* | (2016.01) |

(52) U.S. Cl.

CPC ..... *F21V 23/026* (2013.01); *F21V 23/009* (2013.01); *F21W 2131/103* (2013.01); *F21Y 2101/00* (2013.01); *F21Y 2115/10* (2016.08)

(58) Field of Classification Search

CPC .. F21V 23/002; F21V 17/104; F21V 23/005; F21V 23/026; F21V 23/009; F21K 9/135; F21W 2131/103

See application file for complete search history.

(56) References Cited

U.S. PATENT DOCUMENTS

| | | | | |
|---|---|---|---|---|
| 5,679,018 | A * | 10/1997 | Lopata | H01R 12/716 439/260 |
| 2005/0030754 | A1* | 2/2005 | Licht | H05K 3/326 362/433 |
| 2006/0198147 | A1* | 9/2006 | Ge | F21K 9/135 362/294 |
| 2011/0151723 | A1* | 6/2011 | Liao | H01R 12/57 439/660 |

* cited by examiner

*Primary Examiner* — Karabi Guharay

(74) *Attorney, Agent, or Firm* — Chun-Ming Shih; HDLS IPR Services

(57) ABSTRACT

A positioning structure of an electrical element of a light emitting diode (LED) lamp for is disposed inside a lamp to clip the electrical element. The electrical element can be a power supply of the lamp or a transformer. The positioning structure includes: a base portion fixed inside the lamp, two spring arms standing upright and extending from two ends of the base portion respectively, and two clipping portions disposed on the two spring arms respectively. The two clipping portions are disposed toward each other to form a concave shape, thereby forming a contact portion in contact with the electrical element and applying a clipping force to the electrical element via the two spring arms.

3 Claims, 8 Drawing Sheets

POSITIONING STRUCTURE OF ELECTRICAL ELEMENT OF LED LAMP

BACKGROUND

1. Technical Field

The present invention relates to a lighting equipment and, in particular, to a positioning structure of an electrical element of a light emitting diode (LED) lamp such as a street lamp or other large LED lamps.

2. Related Art

Since a light emitting diode (LED) has advantages such as high luminance, power-saving, and a long life span, it has been widely used in electronic devices or lamp lighting. In order to increase an illumination scope and luminance of the LED, usually plural LEDs are used to constitute an LED lamp set which has been used to replace a conventional large lamp of a bulb and etc., which is for example a street lamp.

In the case of using the LED as a light source of a street lamp or other lamps, there are maintenance or replacement requirements for components/parts in the LED. However, the electrical components, such as a power supply or a transformer hidden inside a streetlamp or other lamps, usually have to be assembled by screws or other troublesome methods, thereby causing inconvenience in maintenance or replacement and difficulty in fast maintenance and replacement.

In view of the foregoing, the inventor made various studies to improve the above-mentioned problems to realize the improvements, on the basis of which the preset invention is accomplished.

BRIEF SUMMARY

It is an object of the present invention to provide a positioning structure of an electrical element of a light emitting diode (LED) lamp, which utilizes a simple clipping portion to quickly position an electrical element such as a power supply or a transformer, and at the same time disassembling can be made quickly to achieve fast maintenance/replacement.

Accordingly, the present invention provides a positioning structure of an electrical element of an LED lamp for being disposed inside a lamp to clip the electrical element. The positioning structure comprises a base portion fixed inside the lamp, two spring arms standing upright and extending from two ends of the base portion, and two clipping portions disposed on the two spring arms respectively. The two clipping portions are disposed toward each other to form a concave shape, thereby forming a contact portion in contact with the electrical element and applying a clipping force to the electrical element via the two spring arms.

Accordingly, the present invention provides a positioning structure of an electrical element of an LED lamp for being disposed inside a lamp to clip the electrical element. A plurality of fins are disposed laterally spaced apart on a side wall of the electrical element, and a gap is formed respectively between the fins. The positioning structure comprises: a base portion, being fixed inside the lamp; two spring arms, standing upright and extending from two ends of the base portion respectively; and two clipping portions, being disposed on the two spring arms respectively, the two clipping portions being disposed toward each other to form a concave shape to contact against the gap, thereby forming a contact portion in contact with the electrical element, and applying a clipping force to the electrical element via the two spring arms.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
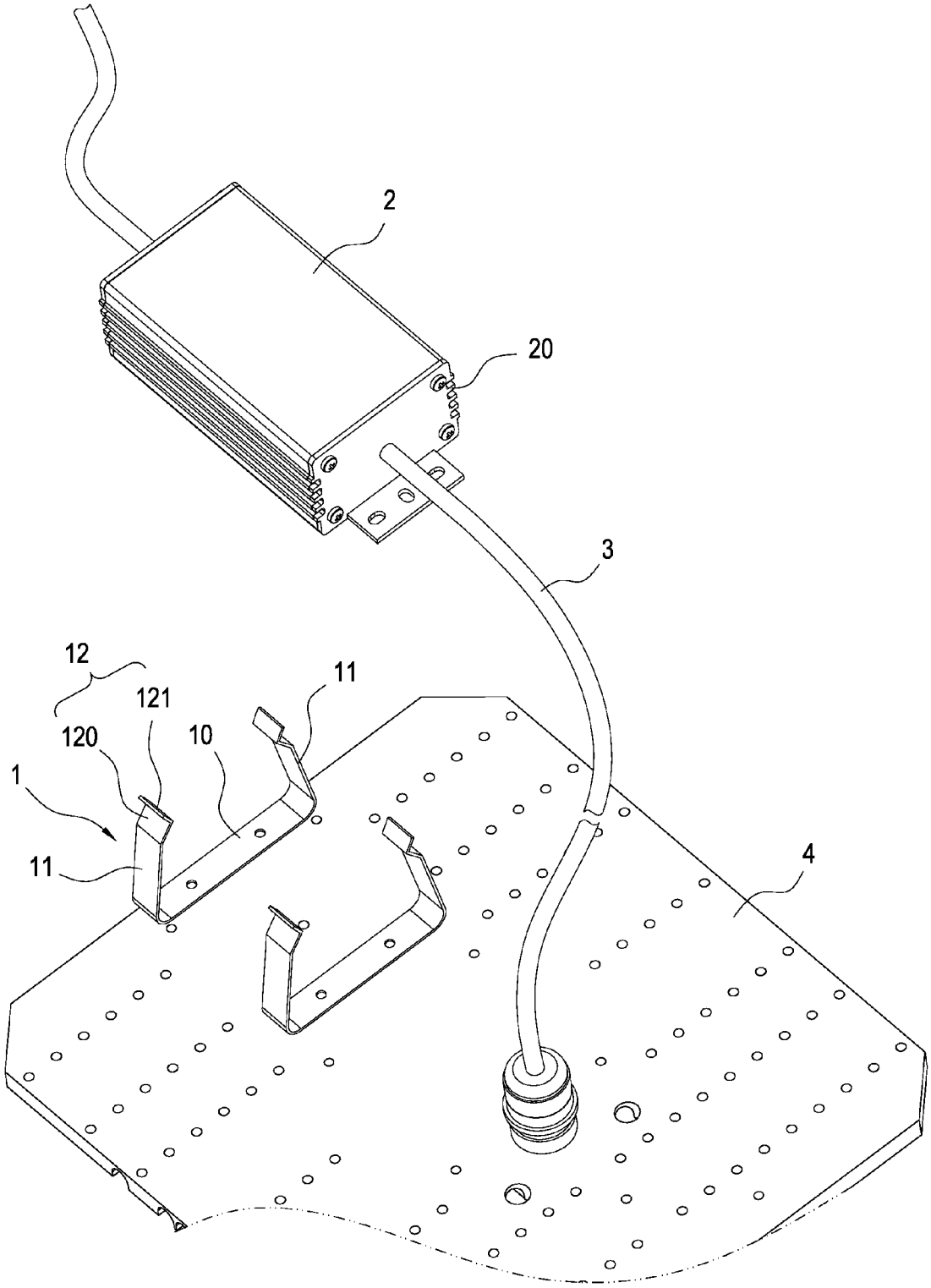
FIG. 1 is a perspective exploded view according to the present invention.
Figure 2:
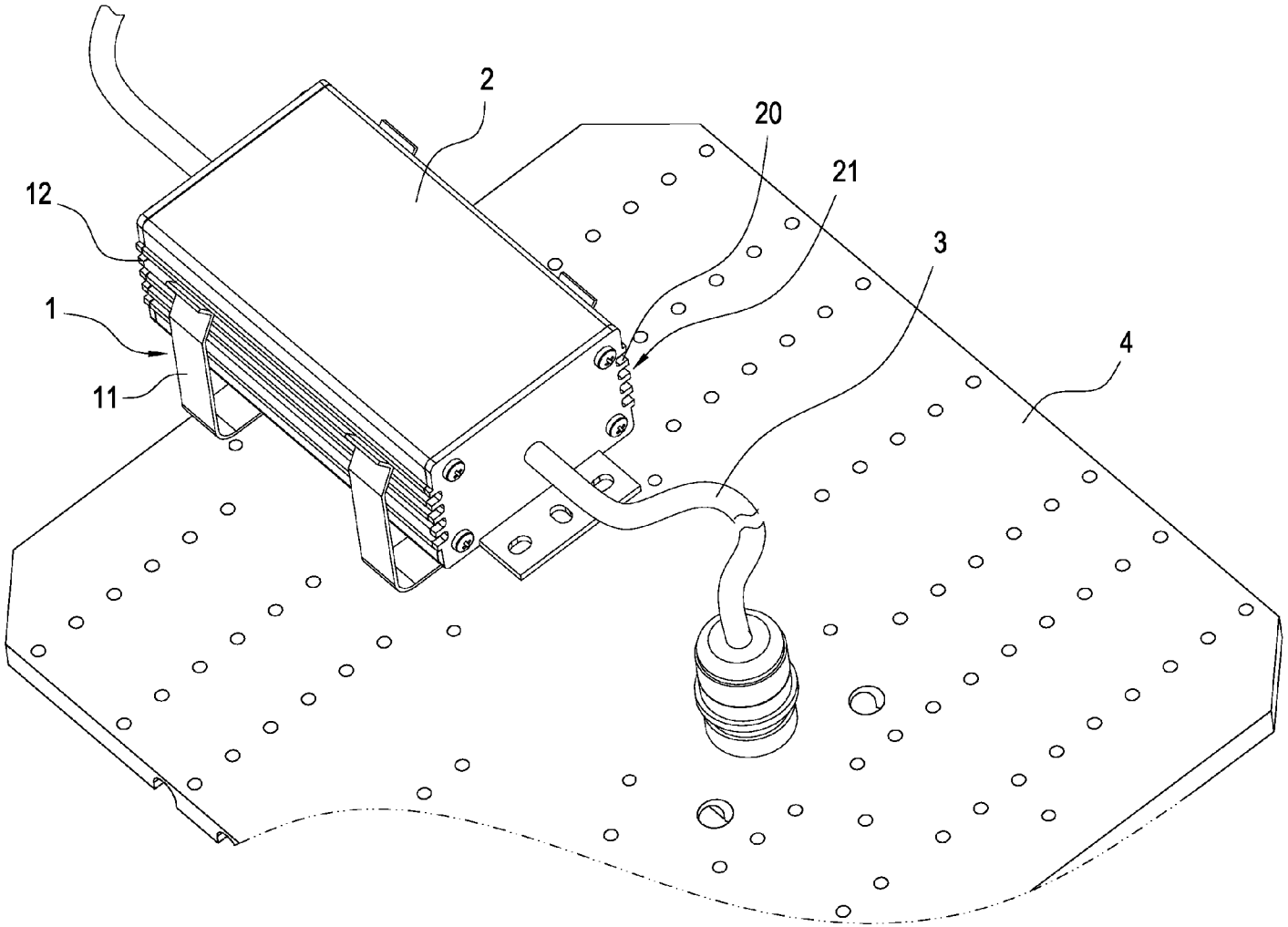
FIG. 2 is a schematic perspective assembled view according to the present invention.

Please refer to FIGS. 1 and 2 which are a perspective exploded view and a perspective assembled view respectively, according to the present invention. The present invention provides a positioning structure of an electrical element of a light emitting diode (LED) lamp, which can be applied to a large LED lamp such as a streetlamp. The positioning structure 1 can be made of a metal plate by pressing and bending and is used for clipping and positioning the electrical element 2 inside the lamp. The electrical element 2 can be a power supply or a transformer and is electrically connected to the lamp via a cable 3. The positioning structure 1 comprises: a base portion 10; two spring arms 11 standing upright and extending from two ends of the base portion 10 respectively; and two clipping portions 12 disposed on the two spring arms 11 respectively. The base portion 10 is provided to be assembled at any appropriate place for being secured by a rivet, weld, screw, or etc. According to the embodiment of the present invention, the base portion 10 is assembled on a heat dissipating device 4 of the lamp, additional positioning structures 1 can be disposed according to the size of the electrical element 2. For example, if the electrical element 2 has a longer length, two positioning structures 1 can be used to clip and secure the electrical element 2, and such that the electrical element 2 can be secured at a desired position more stably.

Figure 3:
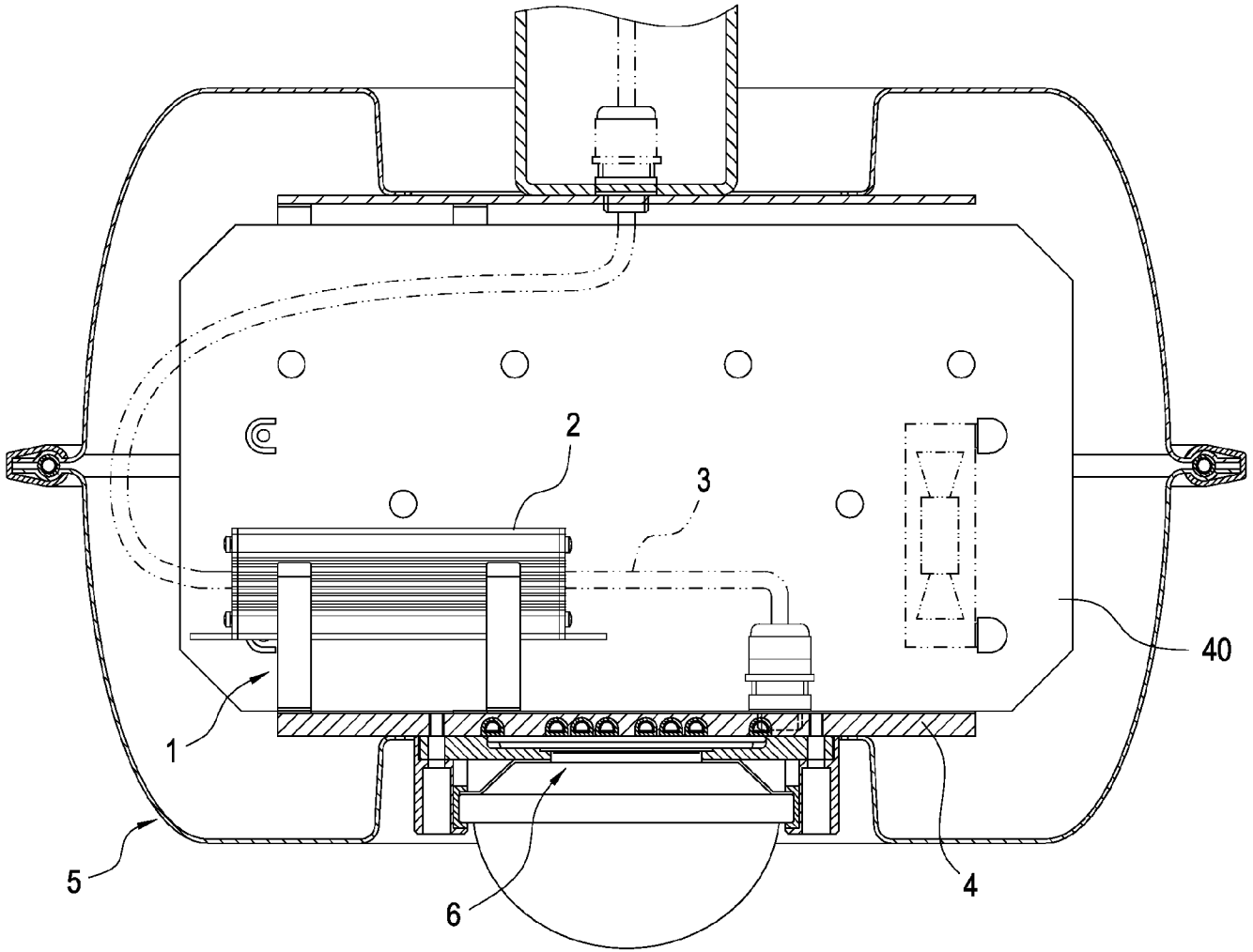
FIG. 3 is a schematic view, illustrating that the present invention is assembled inside a lamp, according to a first embodiment of the present invention.
Figure 4:
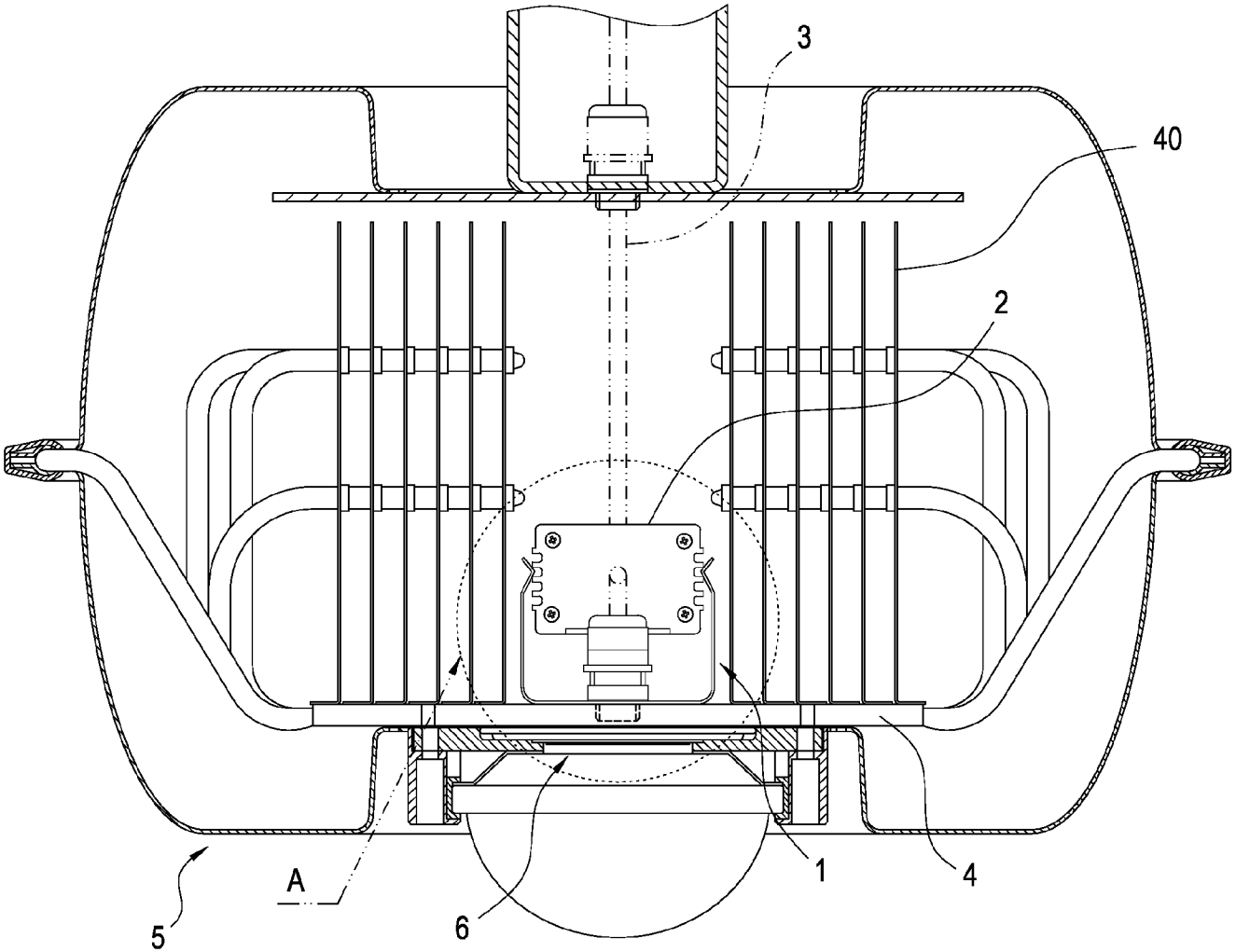
FIG. 4 is another perspective view of the protective case according to the first embodiment of the present invention.

Please also refer to FIGS. 3 and 4. In the embodiment of the present invention, the lamp includes a lamp shell 5, and a heat dissipating device 4 is disposed in the lamp shell 5. On the heat dissipating device 4, there are a plurality of heat dissipating fins 40 disposed to dissipate heat. The heat dissipating device 4 is in contact with an LED light source 6 of the lamp to dissipate heat of the LED light source 6, and a detailed description of which is omitted since it relates to conventional techniques.

Figure 5:
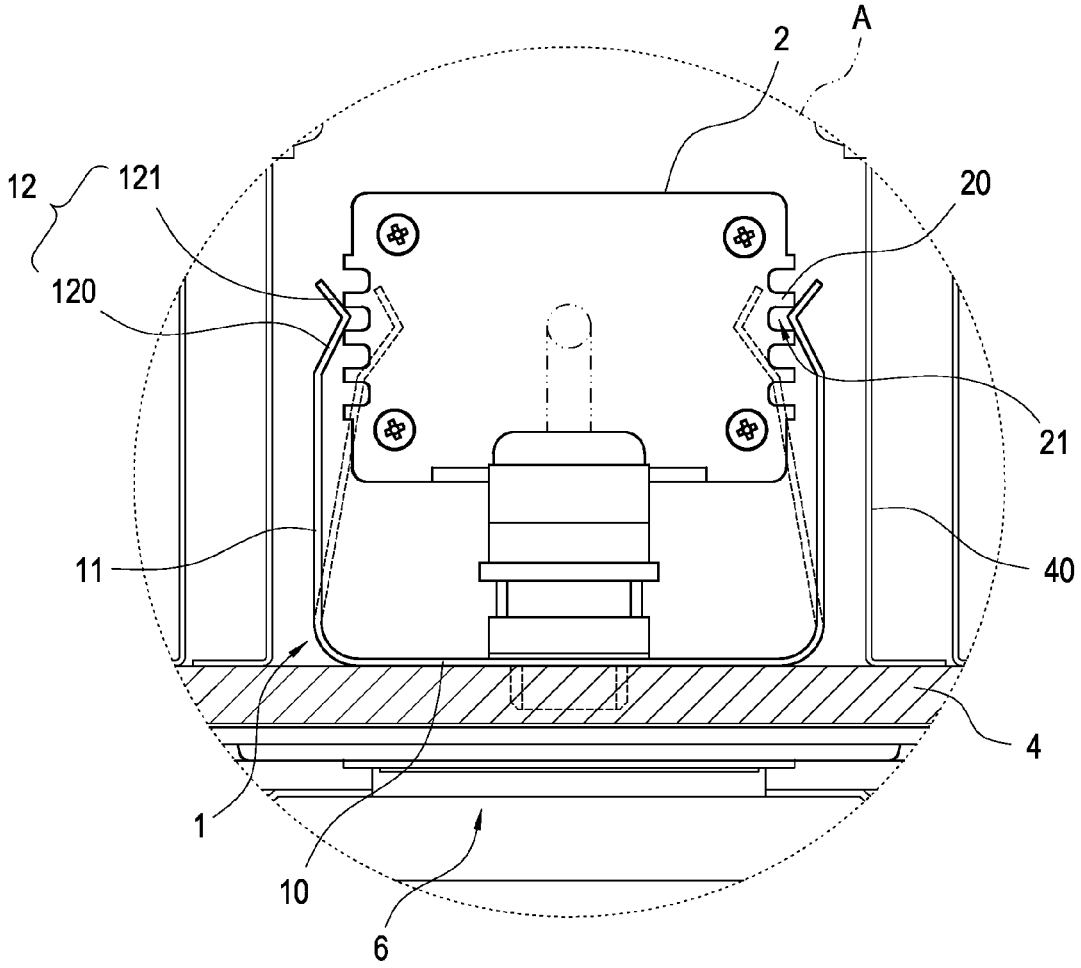
FIG. 5 is an enlarged view of part A of FIG. 4.

Referring to FIG. 5, the two clipping portions of the positioning structure 1 are disposed toward each other to form a concave shape and comprise a first clipping surface 120 and a second clipping surface 121. The first clipping surface 120 and the second clipping surface 121 are inclinedly connected to form the clipping portion 12 and to form a contact portion in a V shape to contact the electrical element 2. At the same time, the elasticity of the two spring arms 11 applies a clipping force to a sidewall of the electrical element 2. A plurality of fins 20 (usually for dissipating heat) are disposed laterally spaced apart on the sidewall of the electrical element 2, and a gap 21 is formed respectively between the fins 20. Therefore, the two clipping portions 12 can contact against any gap 21 to achieve a better positioning effect or can use the gaps 21 at different locations to adjust a relative positioning location between the positioning structure 1 and the electrical element 2.

Figure 6:
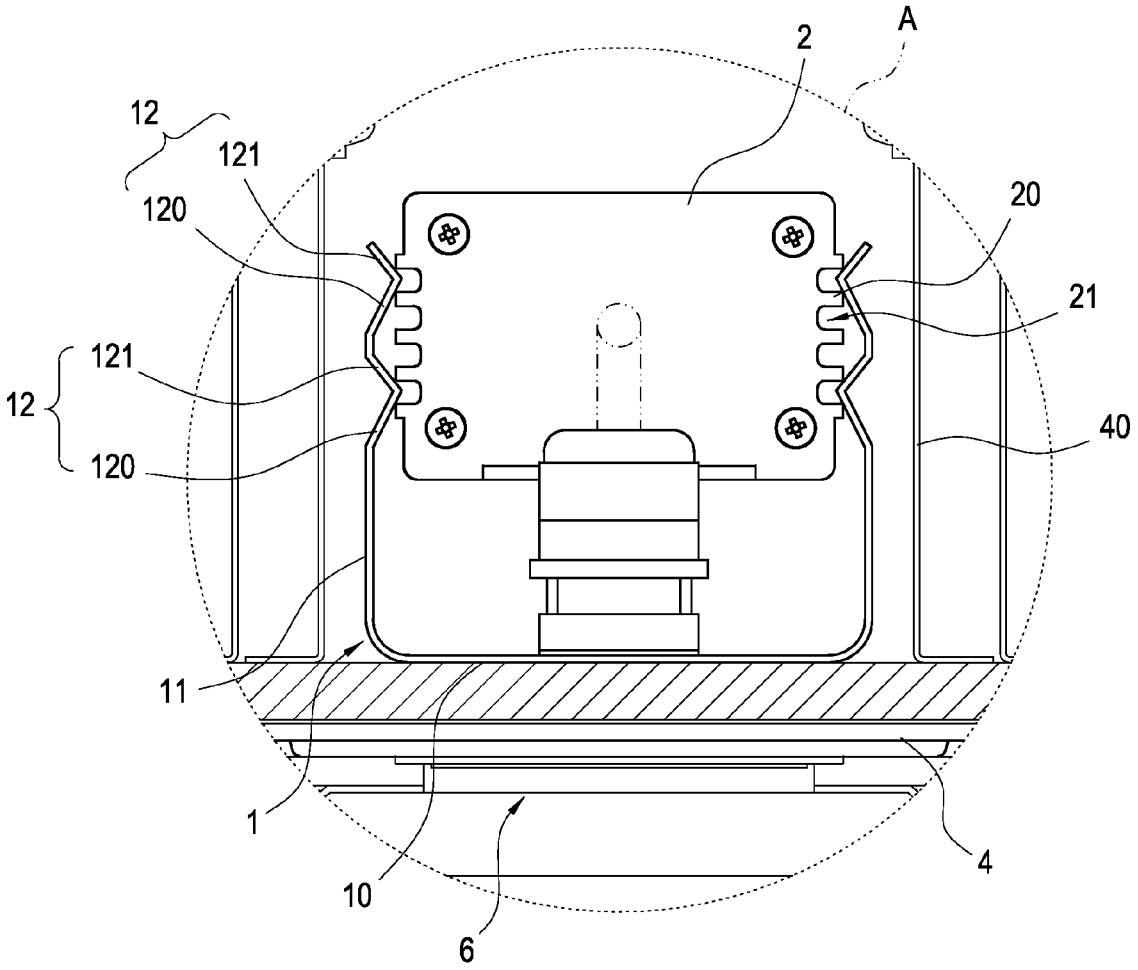
FIG. 6 is an enlarged view of the part A of FIG. 4 according to another embodiment of the present invention.

Moreover, as shown in FIG. 6, in the second embodiment of the present invention, additional clipping portions 12 are further disposed on the two spring arms 11, and the clipping portions 12 of each of the spring arms 11 are disposed in a spaced-out manner along an extending direction of each of the spring arms 11, and such that each spring arm 11 can use the plural clipping portions 12 to contact the electrical element 2, so that the positioning effect between the positioning structure 1 and the electrical element 2 is enhanced and more stable.

Therefore, the above-mentioned structures constitute the present invention, namely the positioning structure of the electrical element of the LED lamp.

Figure 7:
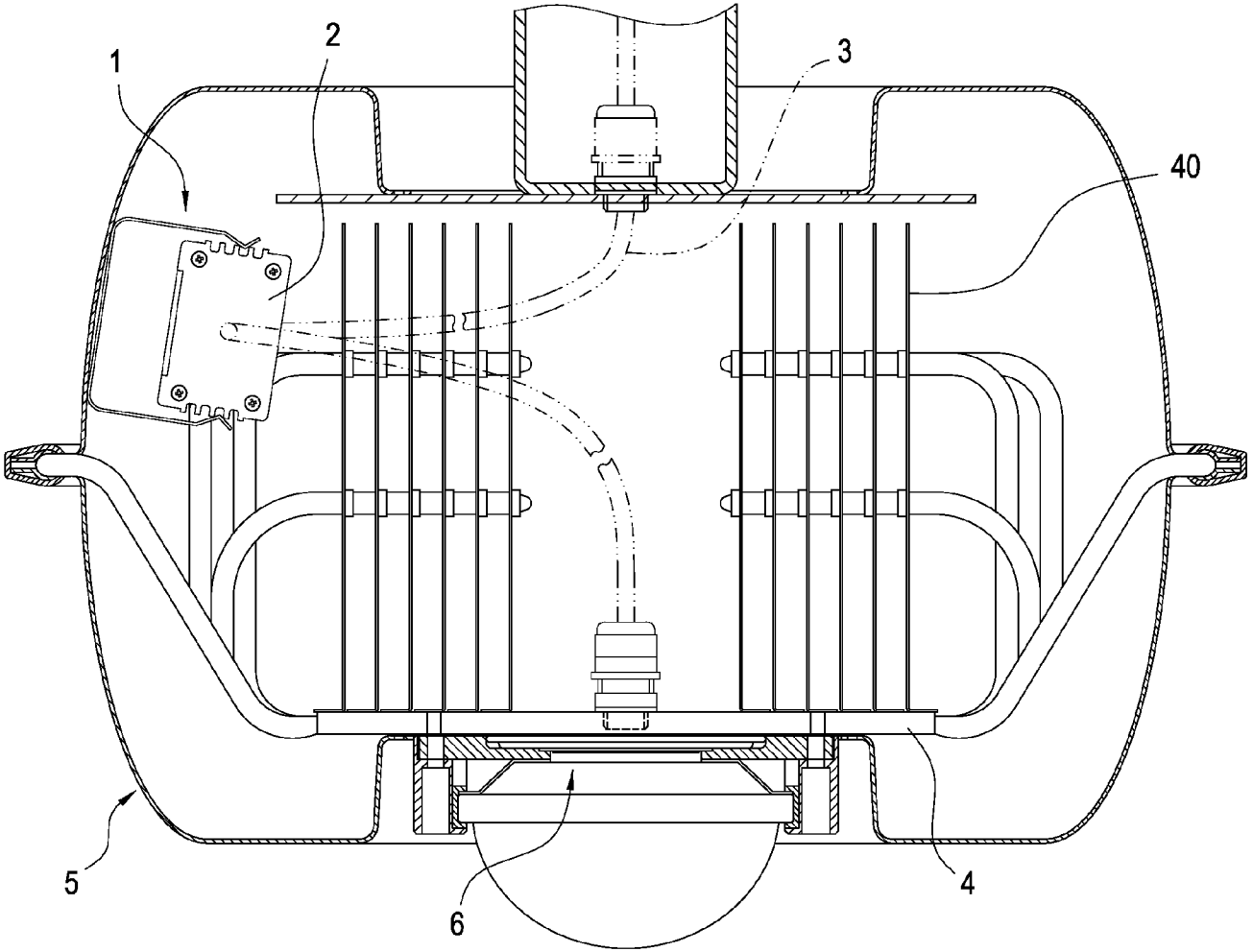
FIG. 7 is a schematic view illustrating that the present invention is assembled inside the lamp according to a second embodiment.
Figure 8:
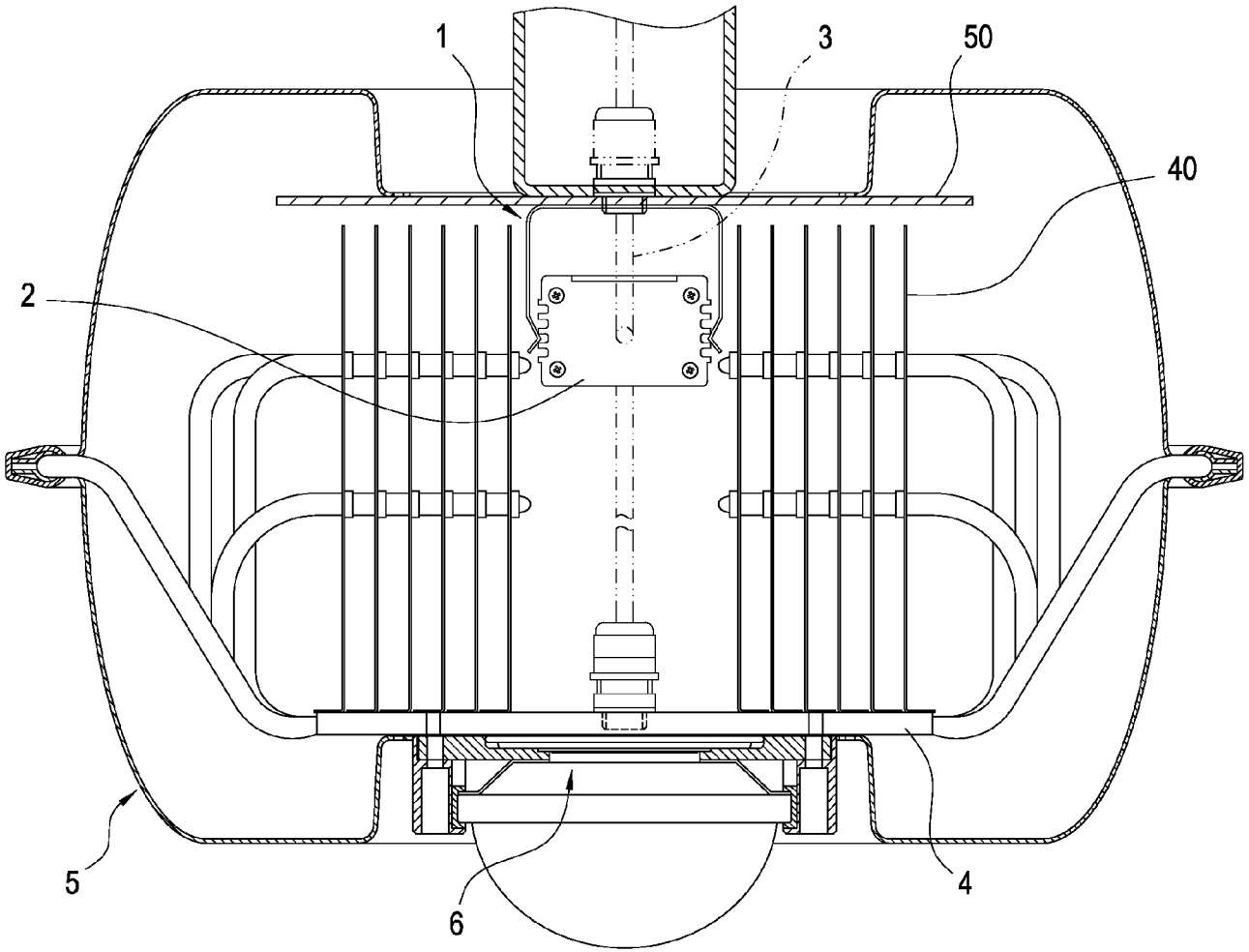
FIG. 8 is a schematic view illustrating that the present invention is assembled inside the lamp according to a third embodiment.

As mentioned above, the positioning structure 1 can quickly position the electrical element 2 by the two spring arms 11. Therefore, maintenance and replacement can also be made quickly. Furthermore, as shown in FIGS. 7 and 8, it only needs to utilize the base portion 10 of the positioning structure 1 to fixedly dispose the positioning structure 1 at any location inside the lamp, so assembling to the lamp is convenient too. According to the layout inside the lamp, the positioning structure 1 is disposed at a space, so as to position the electrical element 2 inside the lamp. Accordingly, the positioning structure 1 can also be disposed at an inner wall (as shown in FIG. 7) of the lamp shell 5 of the lamp or can be disposed inside the lamp in an upside down manner from above.

In summary, the present invention certainly can achieve the anticipated objects and improve the defects of conventional techniques, and has novelty and non-obviousness, so the present invention completely meet the requirements of patentability. Therefore, a request to patent the present invention is filed according to patent laws. Examination is kindly requested, and allowance of the present application is solicited to protect the rights of the inventor.

It is to be understood that the above descriptions are merely preferable embodiments of the present invention and not intended to limit the scope of the present invention. Equivalent changes and modifications made in the spirit of the present invention are regarded as falling within the scope of the present invention.

What is claimed is:

1. A positioning structure of an electrical element of a light emitting diode (LED) lamp for being disposed inside a lamp to clip the electrical element, the positioning structure comprising:

a base portion fixed inside the lamp;

two spring arms standing upright and extending from two ends of the base portion respectively;

a plurality of fins disposed laterally and spaced apart on two opposite side walls of the electrical element to form a plurality of gaps; and two clipping portions extending from the two spring arms respectively, the two clipping portions being formed in wave shape, and two crests of each of the two clipping portions being facing the electrical element and being positioned in two of the plurality of gaps to apply a clipping force to the electrical element via the two spring arms, wherein the base portion, the two spring arms, and the two clipping portions are integrally formed as a single piece metal plate.

2. The positioning structure of the electrical element of the LED lamp of claim 1, wherein the positioning structure is made of a metal plate by pressing and bending.

3. The positioning structure of the electrical element of the LED lamp of claim 1, wherein the two clipping portions comprise a first clipping surface and a second clipping surface respectively, and the first clipping surface and the second clipping surface are inclinedly connected.

* * * * *